US011535574B2

(12) United States Patent
Alexander et al.

(10) Patent No.: US 11,535,574 B2
(45) Date of Patent: Dec. 27, 2022

(54) HIGH ENERGY REDUCED SENSITIVITY TACTICAL EXPLOSIVES

(71) Applicant: BAE Systems Ordnance Systems Inc., Kingsport, TN (US)

(72) Inventors: Thomas Brian Alexander, Kingsport, TN (US); David Wilson Price, Kingsport, TN (US)

(73) Assignee: BAE Systems Ordnance Systems Inc., Kingsport, TN (US)

( * ) Notice: Subject to any disclaimer, the term of this patent is extended or adjusted under 35 U.S.C. 154(b) by 558 days.

(21) Appl. No.: 16/107,378

(22) Filed: Aug. 21, 2018

(65) Prior Publication Data

US 2020/0062671 A1 Feb. 27, 2020

(51) Int. Cl.

| | |
|---|---|
| ***C06B 45/18*** | (2006.01) |
| ***C06B 45/22*** | (2006.01) |
| ***C06B 25/34*** | (2006.01) |
| ***C06B 21/00*** | (2006.01) |
| *C06B 45/20* | (2006.01) |
| *D03D 23/00* | (2006.01) |
| *D03D 43/00* | (2006.01) |

(52) U.S. Cl.

CPC ..... *C06B 25/34* (2013.01); *C06B 21/0083* (2013.01); *C06B 45/22* (2013.01); *C06B 21/0041* (2013.01); *C06B 21/0066* (2013.01)

(58) Field of Classification Search

USPC ..... 149/3, 9, 11

See application file for complete search history.

(56) References Cited

U.S. PATENT DOCUMENTS

| | | | | |
|---|---|---|---|---|
| 3,238,076 | A | 3/1966 | Taylor et al. | |
| 4,251,301 | A | 2/1981 | Voigt, Jr. | |
| 4,421,578 | A | 12/1983 | Voreck, Jr. | |
| 5,529,649 | A | 6/1996 | Lund et al. | |
| 6,881,283 | B2 | 4/2005 | Lee et al. | |
| 6,884,307 | B1 | 4/2005 | Hofmann et al. | |
| 7,754,036 | B1 | 7/2010 | Newman et al. | |
| 8,168,016 | B1 * | 5/2012 | Nicolich | C06B 45/10 149/109.6 |
| 8,252,370 | B1 | 8/2012 | Young et al. | |

(Continued)

OTHER PUBLICATIONS

Scribner et al. High-Performance, Extrusion Cast Explosives with Low Sensitivity. Jan. 10, 1989 [Retrieved Apr. 28, 2020] Retrieved from internet URL: < https://www.osti.gov/servlets/purt/6415125 >.

(Continued)

*Primary Examiner* — James E McDonough

(74) *Attorney, Agent, or Firm* — Patterson Thuente IP

(57) ABSTRACT

A high energy explosive having reduced shock sensitivity for tactical weapon platforms to increase the safety margins to the warfighter if the weapon became involved in an unplanned event on the battlefield. The high energy explosive having a reduced crystalline particle size below about 30 microns, preferably 10 microns, and coated with a thermoplastic elastomer, which is capable of being compressed into a warhead configuration and attached to a weapon. The high energy explosive having a greater than 25% reduction in shock sensitivity compared to the same crystalline energetic material without undergoing size reduction prior to being coated.

16 Claims, 5 Drawing Sheets

(56) References Cited

U.S. PATENT DOCUMENTS

| | | | | |
|---|---|---|---|---|
| 8,747,581 | B2 | 6/2014 | Borne et al. | |
| 2003/0005990 | A1* | 1/2003 | Hofmann | C06B 25/04 149/109.6 |
| 2003/0094224 | A1* | 5/2003 | Lee | C06B 21/0083 149/19.7 |
| 2004/0216822 | A1* | 11/2004 | Hofmann | C06B 25/04 149/92 |
| 2005/0072503 | A1 | 4/2005 | Smith et al. | |
| 2006/0060273 | A1* | 3/2006 | Smith | C06B 45/32 149/92 |

OTHER PUBLICATIONS

International Search Report and Written Opinion from PCT Application PCT/US19/47489, dated May 22, 2020, 9 pgs.

* cited by examiner

HIGH ENERGY REDUCED SENSITIVITY TACTICAL EXPLOSIVES

TECHNICAL FIELD

The present invention is directed to high energy explosives having reduced shock sensitivity for tactical weapon platforms, more particularly a formulation of a crystalline based explosive coated with a thermoplastic elastomer to increase the safety margin of the explosive while maintaining the intended energetic lethality.

BACKGROUND

The Global War on Terror has seen an augmentation of the enemy from a strictly ground based village-to-village insurgency to large coordinated engagement with the use of armor and tactical vehicles. In the development of multipurpose warheads to engage and defeat a target enemy set, the United States government has identified technology gaps in the susceptibility of its weapon platforms. These technology gaps are defined as the weapon being prematurely detonated if subjected to shock from either fragments, bullets or an adjacent munitions detonation.

The United States Department of Defense utilizes man portable, mounted, and air delivered munitions to engage and defeat supplied target enemy sets. These munitions usually contain high amounts of explosive product (92%-95%) to provide the mechanism to defeat the reinforced target sets. However, the high explosive content renders the weapon susceptible to attack from hazards found on the battlefield and endangering the warfighter and associated equipment.

Due to this concern, the United States Department of Defense has started shifting its explosive product portfolio to provide an increased level of safety but has the potential to sacrifice the lethality required to adequately neutralize threats. Additionally, the reduction in energy for the explosive options have led to the munitions improperly functioning by not correctly forming the penetration jets formed by the munitions once activated. Therefore, there is a need for a high energy explosive that can defeat hardened targets but maintains a reduced vulnerability profile to withstand unplanned stimuli attack while matching or exceeding energetic lethality of traditional explosives.

SUMMARY OF THE INVENTION

The present invention is directed toward a high energy explosive that can be used in tactical weapon platforms to defeat hardened targets while having a reduced shock sensitivity to withstand unplanned stimuli attack such as fragments, bullets or an adjacent munition detonation. The high energy explosive of the present invention is also capable of matching or exceeding energetic lethality of traditional explosives.

In some aspects, the high energy insensitive explosive of the present invention comprises a high energy insensitive explosive composition having a plurality of crystalline energetic particles with an average particle size less than 10 microns coated with a thermoplastic elastomer, such that the plurality of coated energetic particles have an average particle size greater than about 50 microns.

In some aspects of the present invention, the high energy insensitive explosive composition is formed by providing a plurality of crystalline energetic particles with an average particle size less than 10 microns and coating the plurality of crystalline energetic particles with a thermoplastic elastomer material dissolved in an organic solvent to form a plurality of coated energetic particles having an average particle size greater than about 50 microns.

In some aspects, the plurality of crystalline energetic particles are provided from a source of standard explosive material milled to an average particle size less than 10 microns. In some aspects, the standard explosive material undergoes fluid energy milling (FEM), which occurs by feeding the source of standard explosive material via a feed hopper into a micronizer mill while air is forced through the milling chamber on a tangential plane to impart particle-to-particle impact on the crystalline energetic material until the desired size is obtained. In some aspects, compressed air is employed in the milling chamber. In some other aspects, an inert gas is employed in the milling chamber. The newly formed FEM crystalline energetic material can then be pressurized into a collection apparatus. A desired quantity of the FEM crystalline energetic material can be added to a plastic bonded explosive coating apparatus as a water wet slurry of the FEM crystalline energetic material and coated with a lacquer composition comprising a thermoplastic elastomer dissolved in an organic solvent by precipitating the thermoplastic elastomer onto the surface of the FEM crystalline energetic material until the desired size of the coated energetic particles is obtained.

In some aspects, the coated energetic particles can be configured into an insensitive munition explosive to be placed within an explosive device. In some aspects, the coated energetic particles are configured into an insensitive munition explosive by pressing a desired amount of the coated energetic particles into a desired billet configuration. In some aspects, the desired configuration is such that the compressed high energy insensitive explosive can then be placed within an explosive device, such as a missile warhead, grenade, artillery, bombs, or other munition.

In some aspects, the plurality of crystalline energetic particles prior to being coated has an average particle size between about 0.5 microns to about 30 microns, preferably between 0.5 microns to about 20 microns, preferably between 0.5 microns to about 15 microns, preferably between about 0.5 microns to about 10 microns, preferably between about 0.6 microns to about 20 microns, preferably between about 0.75 microns to about 15 microns, preferably between about 0.85 microns to about 10 microns, preferably between about 0.85 microns to about 9 microns, preferably between about 1 micron to about 8 microns, preferably between about 1 micron to about 7 microns, preferably between about 1 micron to about 6 microns, preferably between about 1 micron to about 5 microns, preferably between about 1 micron to about 4 microns, and most preferably between about 1 micron and 3 microns.

In some aspects, at least 20%, at least 30%, preferably at least 40%, preferably at least 50%, preferably at least 60%, preferably at least 70%, preferably at least 80%, preferably at least 90%, preferably at least 95%, more preferably at least 99%, most preferably up to 100% of the plurality of crystalline energetic particles prior to coating have an average particle size of less than about 30 microns, preferably less than about 20 microns, preferably less than about 10 microns, in some aspects between about 0.5 microns to about 10 microns, preferably between about 0.75 microns to about 7.5 microns, preferably between about 0.85 microns to about 5 microns, and most preferably between about 1 micron and 3 microns.

In some aspects, at least 75% and up to about 100% of the plurality of crystalline energetic particles prior to being coated having an average particle size of less than 30 microns, preferably less than about 20 microns, most preferably less than about 10 microns, preferably between about 0.5 microns to about 30 microns, preferably between about 0.6 microns to about 20 microns, preferably between about 0.75 microns to about 15 microns, preferably between about 0.85 microns to about 10 microns, preferably between about 0.85 microns to about 9 microns, preferably between about 1 micron to about 8 microns, preferably between about 1 micron to about 7 microns, preferably between about 1 micron to about 6 microns, preferably between about 1 micron to about 5 microns, preferably between about 1 micron to about 4 microns, and most preferably between about 1 micron and 3 microns.

In some aspects, the plurality of crystalline energetic particles comprises a standard energetic material provided at the desired size, such as by fluid energy milling. In some aspects, the plurality of crystalline energetic particles comprises an HMX (e.g., 1,3,5,7-tetranitro-1,3,5,7-tetraazacyclooctane or octogen) provided at the desired size, such as by fluid energy milling. In some other aspects, the plurality of crystalline energetic particles comprises a standard HMX Class 1 explosive (e.g., 1,3,5,7-tetranitro-1,3,5,7-tetraazacyclooctane) provided at the desired size, such as by fluid energy milling. In some aspects, the plurality of crystalline energetic particles comprises HMX Class 1, HMX Class 2, Cowles ground Class 2, HMX Class 3, HMX Class 4, HMX Class 5, or combinations or mixtures thereof.

In some aspects, the plurality of crystalline energetic particles comprises 1,3,5,7-tetranitro-1,3,5,7-tetraazacyclooctane and at least 80% of the plurality of crystalline energetic particles prior to being coated have an average particle size of less than less than about 30 microns, preferably less than about 20 microns, most preferably less than about 10 microns, preferably between about 0.5 microns to about 30 microns, preferably between about 0.6 microns to about 20 microns, preferably between about 0.75 microns to about 15 microns, preferably between about 0.85 microns to about 10 microns, preferably between about 0.85 microns to about 9 microns, preferably between about 1 micron to about 8 microns, preferably between about 1 micron to about 7 microns, preferably between about 1 micron to about 6 microns, preferably between about 1 micron to about 5 microns, preferably between about 1 micron to about 4 microns, and most preferably between about 1 micron and 3 microns. 10 microns, preferably between about 0.5 microns to about 10 microns, preferably between about 0.75 microns to about 7.5 microns, preferably between about 0.85 microns to about 5 microns, and most preferably between about 1 micron and 3 microns.

In some aspects of the present invention, the plurality of crystalline energetic particles can be coated with any plastic material that will reduce shock sensitivity without adversely impacting the intended energetic lethality. In some aspects, the plurality of crystalline energetic particles are encapsulated in at least one plastic material. In some aspects, the plastic material comprises at least one thermoplastic elastomer. In some aspects, the thermoplastic elastomer is a polyester-based thermoplastic polyurethane, a polyether-based thermoplastic polyurethane, a polyacrylates, or a combination thereof.

In some aspects, the coated crystalline energetic particles are present in an amount greater than 3 wt-% up to about 10 wt-%, in some aspects between about 4 wt-% to about 8 wt-%, and preferably between about 5 wt-% to about 7.5 wt-%, based upon the total weight of the high energy insensitive explosive composition.

In some aspects, the plurality of coated crystalline energetic particles have an average particle size greater than about 50 microns and up to about 5000 microns, preferably between about 100 microns and about 4000 microns, most preferably between about 150 microns and about 3000 microns.

In some aspects, the high energy insensitive explosive of the present invention has a reduced shock sensitivity of at least 25% compared to the same crystalline energetic particles having a standard average particle size using the Naval Ordnance Laboratory Large Scale Gap Test, such as the same crystalline energetic particles having an average particle size greater than 10 microns.

In some aspects, the plurality of crystalline energetic particles are provided in a water wet slurry after being fluid energy milled, and a lacquer comprising the at least one elastomeric material dissolved into an organic solvent is fed into the slurry to form a mixture, whereby at least one elastomeric material is precipitated onto each of the plurality of crystalline energetic particles.

In some aspects, the plurality of coated crystalline energetic particles have a press density greater than 1.6 and less than about 1.9. In some aspects, the plurality of coated crystalline energetic particles are configured into a desired munition, such as a missile warhead or other less powerful tactical weapon platforms, including, for example, shoulder launched missiles, grenades, artillery, or other munitions.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
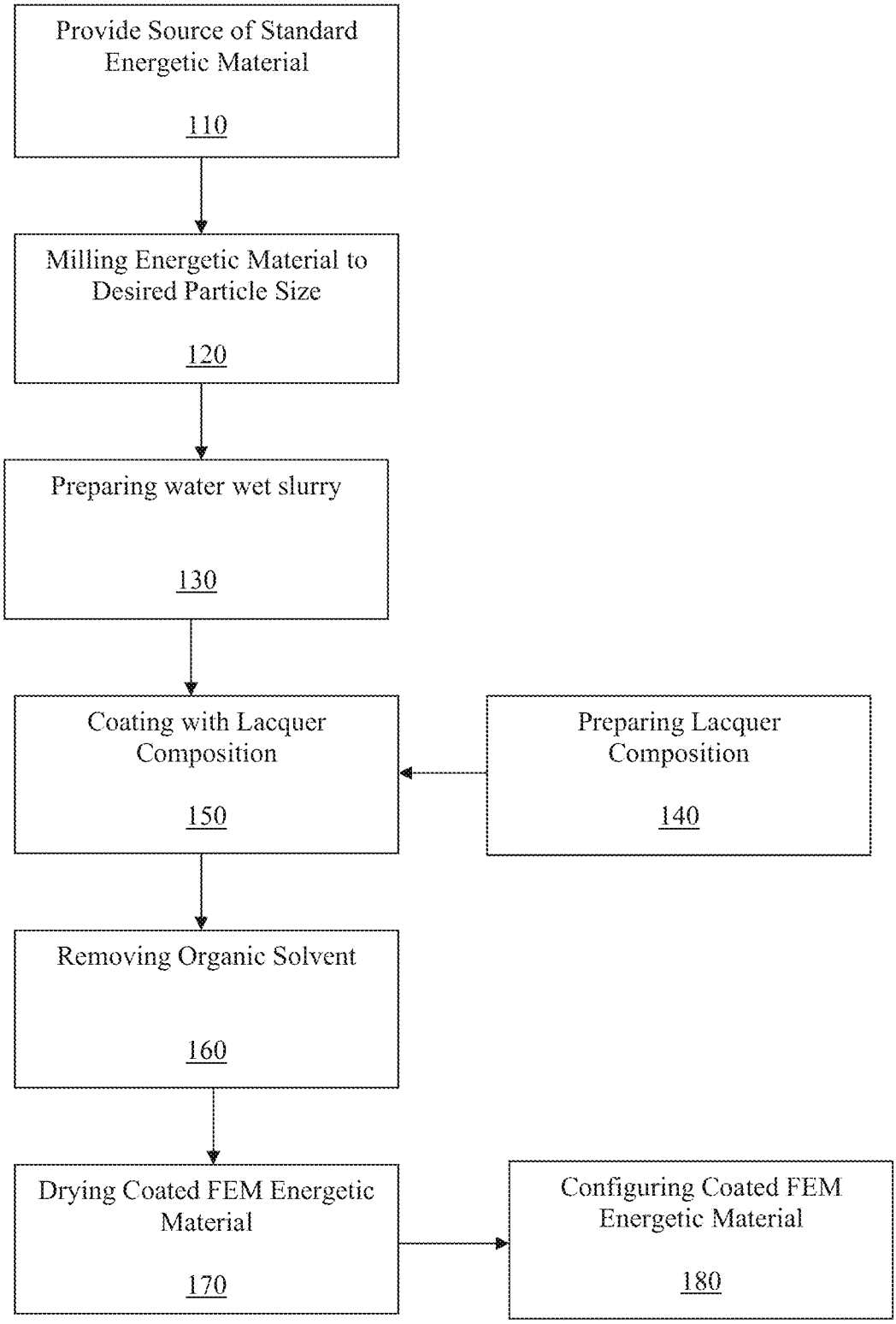
FIG. 1 is a flow diagram illustrating the formation of a high energy insensitive explosive according to certain aspects of the present invention.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The present invention is directed towards incorporating crystalline based explosives that have been fluid energy milled (FEM) to reduce their particle size in the nano to micron range prior to being coated with a plastic material, which can be used in explosive formulations that are subsequently loaded into tactical weapon platforms including missiles, grenades, artillery, and bombs to defeat hardened targets. These high energy insensitive explosives match or exceed energetic lethality of traditional explosives while reducing shock sensitivity to withstand unplanned stimuli attack such as fragments, bullets or an adjacent munition detonation.

Referring now to the Figures, FIG. 1 provides a flow diagram illustrating the formation of a high energy insensitive explosive according to certain embodiments of the present invention. The high energy insensitive explosive is preferably formed by providing a source of standard energetic material 110, fluid energy milling the source of standard energetic material to a desired particle size 120, preparing a water wet slurry of the milled energetic material, preparing a lacquer composition 140, coating the crystalline energetic material having the desired particle size with the lacquer composition 150, removing residual organic solvent from the slurry process 160, drying the coated crystalline energetic material 170, and configuring the coated crystalline energetic material 180.

In some aspects, the source of standard energetic material provided 110 comprises an HMX explosive material, also known as Octogen and 1,3,5,7-tetranitro-1,3,5,7-tetraazacyclooctane, having the chemical formula $C_4H_8O_8N_8$ with the chemical structure shown in Formula I:

(Formula I)

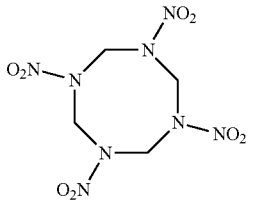

Figure 3:
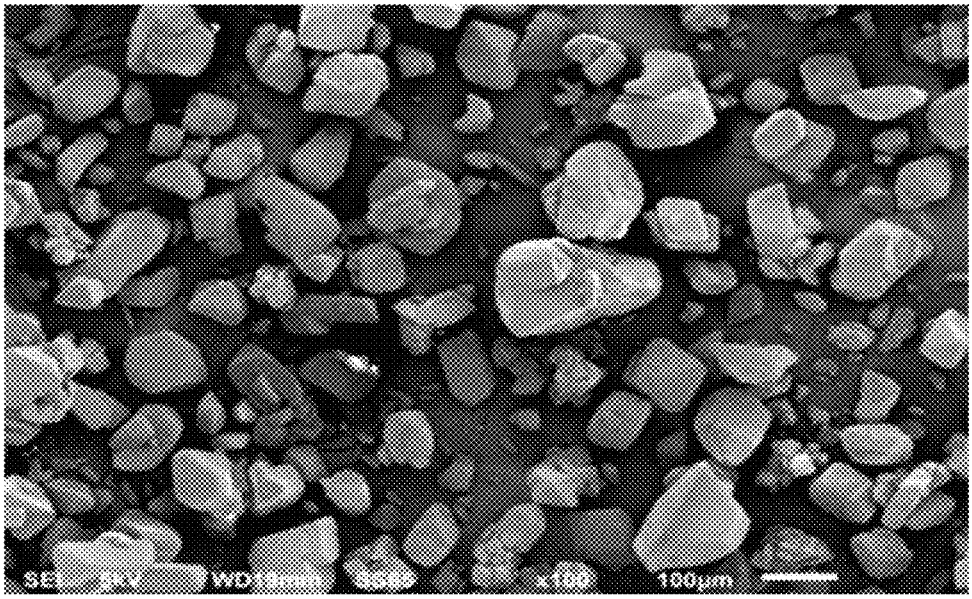
FIG. 3 is a scanning electron microscope image of high energy explosive particles prior to particle size reduction according to certain aspects of the present invention.

HMX has a crystal density of 1.9 g/cm$^3$, a detonation velocity of 9100 m/s, an impact sensitivity of 7.4 N/m, and a friction sensitivity of 120 N. In some preferred aspects, the source of standard energetic material provided comprises a standard HMX Class 1 explosive material. Crystalline particles of HMX Class 1 normally have an average spheroid crystal particle size greater than about 45 microns and up to about 400 microns. FIG. 3 shows a scanning electron microscope image of a plurality of HMX Class 1 energetic particles. Various other classes of HMX explosive material may also be used, including HMX Class 1, HMX Class 2, HMX Class 3, HMX Class 4, HMX Class 5, or combinations or mixtures thereof.

While HMX is specifically identified, it is contemplated that other existing and emerging energetic materials may also be used according to certain aspects of the present invention. In certain aspects, it is contemplated that the energetic material may be a nitramine. In some aspects, it is contemplated that the energetic material may be chosen from HMX, RDX (e.g., 1,3,5-Trinitro-1,3,5-triazinane), NTO (e.g., 3-nitro-1,3,4-triazole-5-one), TATB (e.g., 2,4,6-triamino-1,3,5-trinitrobenzene), or combinations and mixtures thereof.

Figure 2:
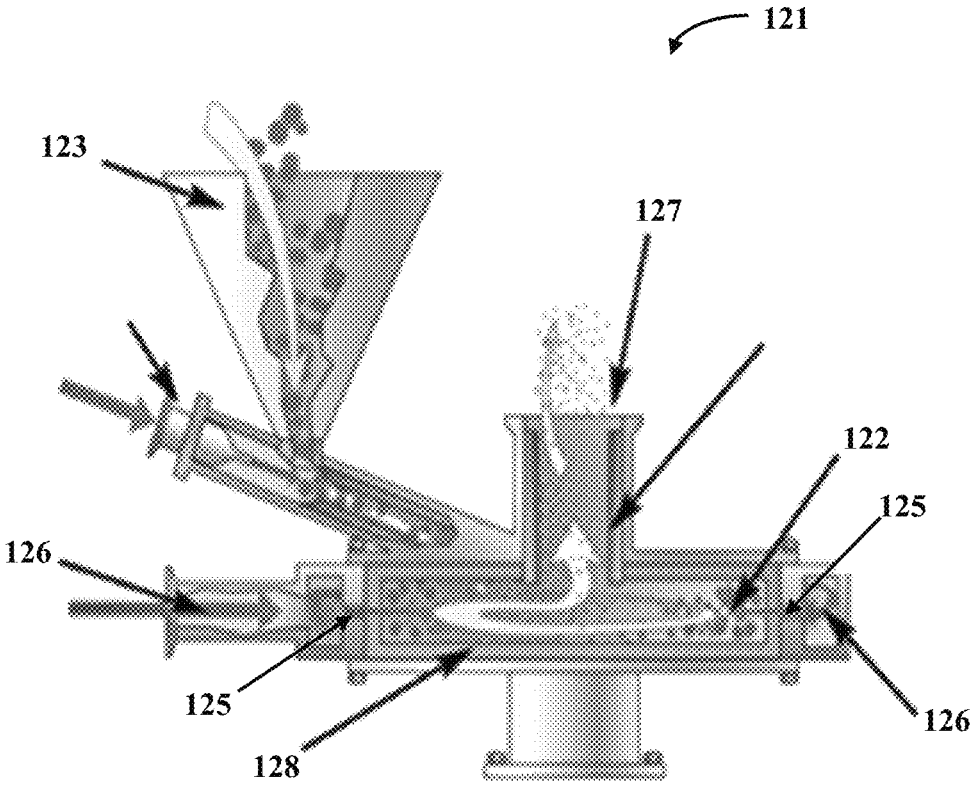
FIG. 2 is a schematic of a milling apparatus to form the high energy insensitive explosive according to certain aspects of the present invention.

In some aspects, the standard energetic material is preferably milled 120 to a desired average particle size below 10 microns. Referring to FIG. 2, an exemplary milling apparatus 121 is shown for the milling 120 process. In some aspects, the standard energetic material is fluid energy milled (FEM) by feeding the standard energetic material into the milling or grinding chamber 122 of the micronizer mill, such as by a hopper or feed funnel 123 with a compressed feed air or gas 124. In some aspects, an inert gas is used to feed the standard energetic material from the hopper or feed funnel 123 to the milling or grinding chamber 122. In some aspects, the micronizer mill contains small openings 125 that supplied compressed air or gas 126 is forced through on a tangential plane, which imparts particle-to-particle impact on the standard energetic material until the desired average particle size is obtained within the milling or grinding chamber 122. The plurality of crystalline energetic particles that have undergone fluid energy milling to the desired average particle size may then be pressurized into a collection apparatus and be removed from the milling apparatus 121 through a product outlet 127. The plurality of crystalline energetic particles that have been milled may be held in a collection apparatus until used in a coating step. The milling apparatus 121 may optionally utilize a liner 128 in the milling or grinding chamber 122. The fluid energy milling has the advantage of no moving parts, there is no sensitized handling of the energetic material, there is no extended friction or pinch points in the processing, and there is no need to collect explosive dust from the system.

In some aspects, the plurality of crystalline energetic particles that have undergone fluid energy milling have an average particle size of less than about 30 microns, preferably less than about 20 microns, most preferably less than about 10 microns. In some aspects, the plurality of crystalline energetic particles that have undergone fluid energy milling have an average particle size between about 0.5 microns to about 30 microns, preferably between about 0.6 microns to about 20 microns, preferably between about 0.75 microns to about 15 microns, preferably between about 0.85 microns to about 10 microns, preferably between about 0.85 microns to about 9 microns, preferably between about 1 micron to about 8 microns, preferably between about 1 micron to about 7 microns, preferably between about 1 micron to about 6 microns, preferably between about 1 micron to about 5 microns, preferably between about 1 micron to about 4 microns, and most preferably between about 1 micron and 3 microns.

After providing the energetic material at the desired average particle size, the energetic material may then be provided in a water wet slurry within a vessel 130 and coated 150 with a prepared lacquer composition 140.

In some aspects, a water wet slurry can be prepared 130 by feeding a desired quantity of crystalline energetic particles having the desired average particle size into a plastic bonded explosive (PBX) coating apparatus having a predetermined quantity of water and applying agitation to generate a water wet slurry of crystalline energetic particles in which the coating chemistry will take place. In some aspects, the ratio of the explosive material to water is about at least 3:1 up to about 5:1 (explosive:water).

In a separate vessel, a lacquer composition can be prepared 140 from an organic solvent having at least one plastic material to be coated onto the surface of the crystalline energetic particles dissolved within the organic solvent. In some aspects, the plastic material is dissolved into the organic solvent at room temperature (e.g., about 25° C.) up to an elevated temperature of about 70° C., preferably above about 55° C. up to about 70° C., more preferably between about 55° C. to about 65° C. In some aspects In some aspects, the at least one plastic material is chosen to reduce the shock sensitivity of the crystalline energetic particles a desired amount without adversely impacting the intended energetic lethality. In some aspects, the at least one plastic material comprises an elastomeric material. In some aspects, the at least one plastic material comprises a synthetic polymer thermoplastic elastomer. In some aspects, the at least one plastic material is a thermoplastic elastomer. In some aspects, the thermoplastic elastomer is a polyester-based thermoplastic polyurethane, a polyether-based thermoplastic polyurethane, a polyacrylate, or a combination thereof. In some aspects, the thermoplastic elastomer has a Shore A hardness using ASTM D2240 Standard between about 66 and 95. In some aspects, the thermoplastic elastomer has a Shore D hardness using ASTM D2240 Standard between 52 and 68. In a preferred embodiment, the thermoplastic elastomer is ESTANE™ 5703 TPU (polyester type thermoplastic polyurethane) manufactured by LUBRIZOL™. In another preferred embodiment, the thermoplastic elastomer is ZEON™ HYTEMP™ 4454, which is a polyacrylates elastomer binder manufactured by Zeon Europe GmbH. In some other aspects, the at least one plastic material comprises a plasticizer. In some aspects, the plasticizer is dioctyl adipate. In some aspects, the at least one plastic material comprises ZEON™ HYTEMP™ 4454 with dioctyl adipate as a plasticizer.

In some aspects, the organic solvent is chosen to adequately dissolve the at least one plastic material. In some aspects, the organic solvent is methyl ethyl ketone (MEK), ethyl acetate, or combinations or mixtures thereof. In some aspects, the organic solvent is in a water saturate configuration. In some aspects, the organic solvent is pure.

In some aspects, the lacquer composition comprises the at least one plastic material present in the organic solvent in an amount greater than 3 wt-% up to about 10 wt-%, in some aspects between about 4 wt-% to about 8 wt-%, and preferably between about 5 wt-% to about 7.5 wt-%.

The coating of the milled energetic material with the lacquer composition 150 can occur by adding the lacquer composition to the vessel containing water wet slurry of crystalline energetic particles. In some aspects, the ratio of the solvent to water is about at least 3:1 up to about 5:1 (solvent:water). In some aspects, the lacquer composition transfer can occur by a gravity feed or diaphragm pump apparatus. As the lacquer composition contacts the surface of the water wet slurry, the organic solvent becomes diluted to the point that the plastic material precipitates out of solution and onto the crystal surface of the crystalline energetic particles. This precipitation reaction can be controlled by the solvent-water ratio. The coated crystalline energetic particle formation starts as small granules and increases in size over time as additional plastic material precipitates onto the crystal surface of the crystalline energetic particles. Once the desired size of coated crystalline energetic particles is obtained, additional water can be introduced to stop the precipitation. In some preferred aspects, the solvent to water is at least about 3.8:1 (solvent: water) to control the precipitation reaction.

Figure 4:
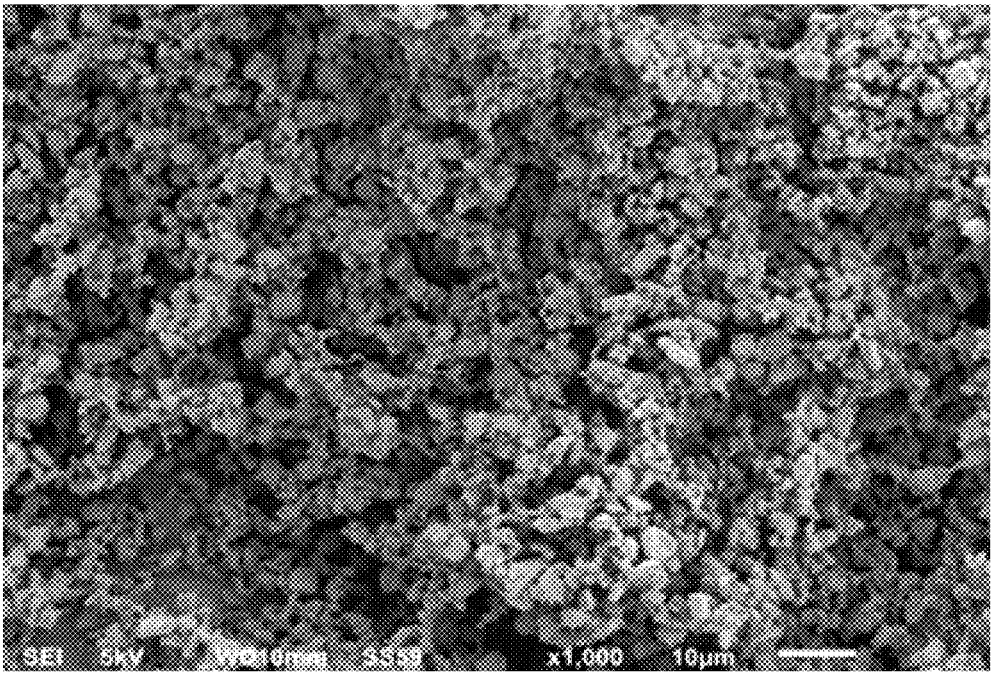
FIG. 4 is a scanning electron microscope image of high energy insensitive explosive particles after undergoing particle size reduction and coating according to certain aspects of the present invention.
Figure 5:
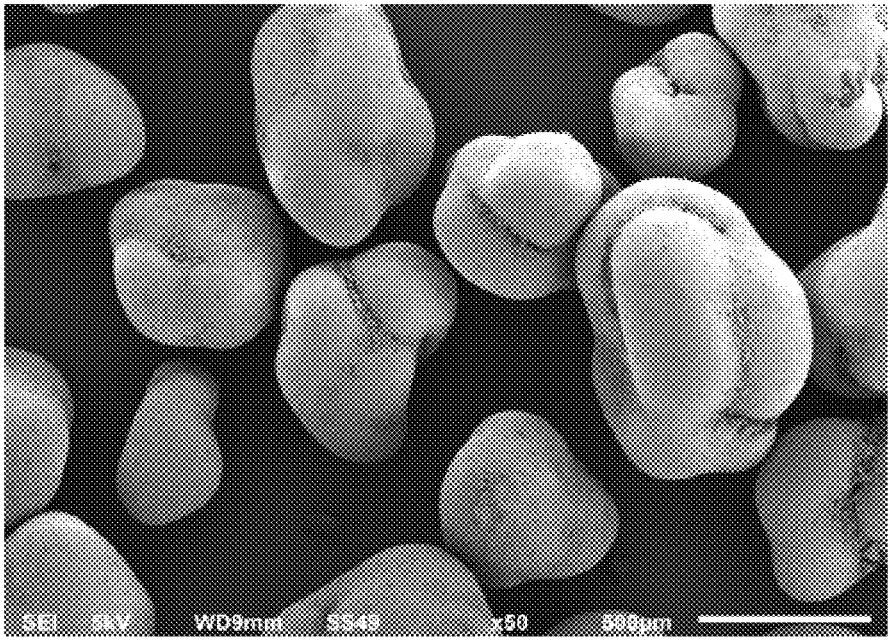
FIG. 5 is a scanning electron microscope image of high energy insensitive explosive particles according to certain aspects of the present invention.
Figure 6:
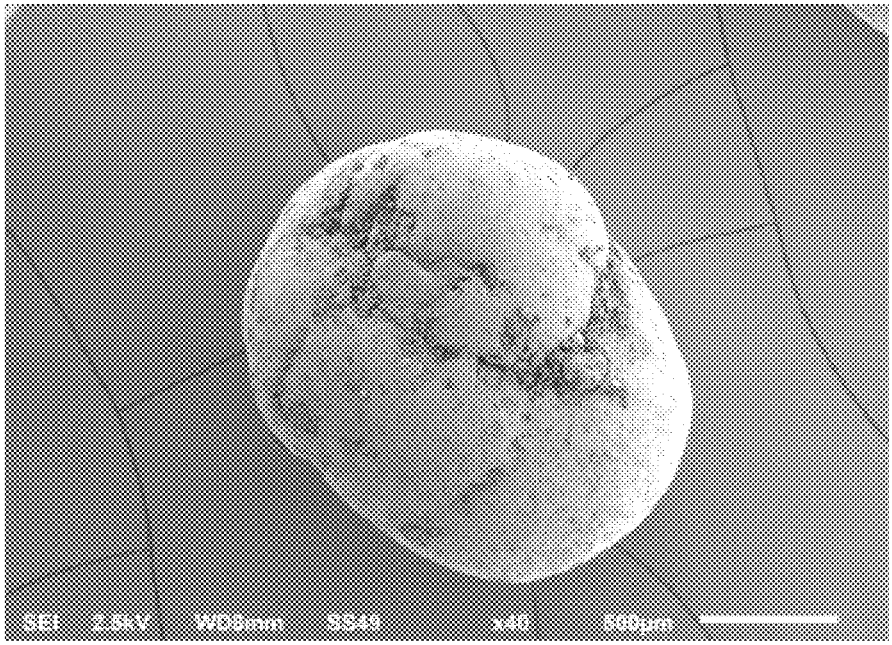
FIG. 6 is a scanning electron microscope image of a high energy insensitive explosive particle according to certain aspects of the present invention.
Figure 7:
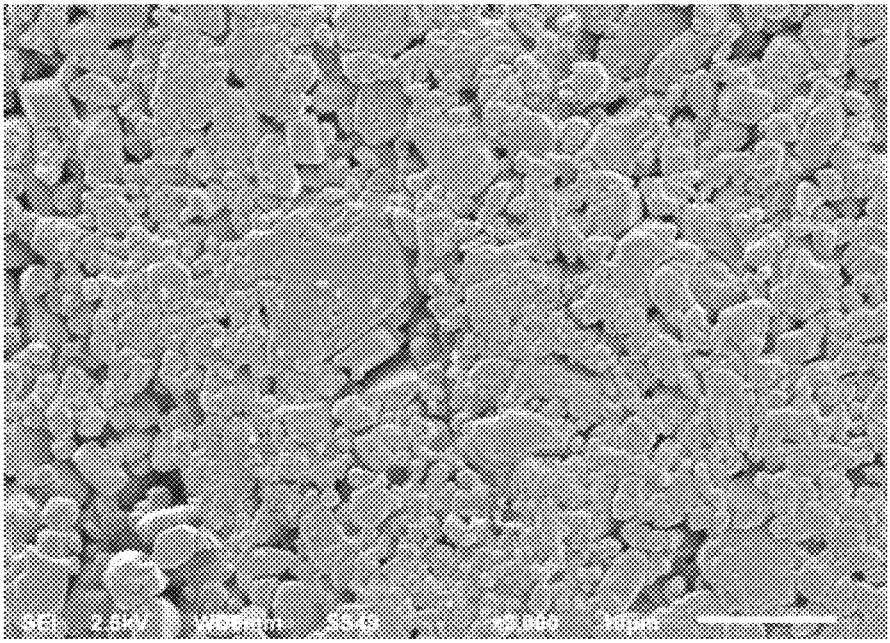
FIG. 7 is a scanning electron microscope image of the surface of the high energy insensitive explosive particle of FIG. 4.

In some aspects, the coated energetic particles have an average particle size greater than about 50 microns and up to about 5000 microns, preferably between about 100 microns and about 4000 microns, most preferably between about 150 microns and about 3000 microns. FIG. 4 shows a scanning electron microscope image of a plurality of HMX Class 1 energetic particles that have undergone fluid energy milling and coated with a mixture of HYTEMP™ and dioctyl adipate according to certain aspects of the present invention. FIG. 5 shows a scanning electron microscope image of a plurality of HMX Class 1 energetic particles that have undergone fluid energy milling and coated with ESTANE™ according to certain aspects of the present invention, while FIG. 6 shows a scanning electron microscope image of a single coated energetic particle coated with ESTANE™ according to certain aspects of the present invention. FIG. 7 is a scanning electron microscope image of the surface of the high energy insensitive explosive particle of FIG. 6, showing the crystal surface of the crystalline energetic particle coated with the plastic material.

In some aspects, the coated energetic particles comprise about 3 to about 8 weight percentage, preferably about 3.5 to about 7.5 weight percentage, more preferably about 3.9 to about 7.2 weight percentage, and in some other aspects preferably about 3.9 to about 5.1 weight percentage, of the thermoplastic elastomer based upon the total weight of the coated energetic particles.

The organic solvent can be removed 160 from the coated crystalline energetic particles. In some aspects, the organic solvent is removed by evaporation, heating, or distillation. In some aspects, the organic solvent is distilled from the coated crystalline energetic particles and recovered for reuse. The organic solvent removal hardens the coated crystalline energetic particles and allows handling.

The coated crystalline energetic particles can also be dried 170, such as using a steam heated to remove residual organic solvent and water. In some aspects, the coated crystalline energetic particles can be dried to remove the organic solvent and water without undergoing the distillation process.

Figure 8:
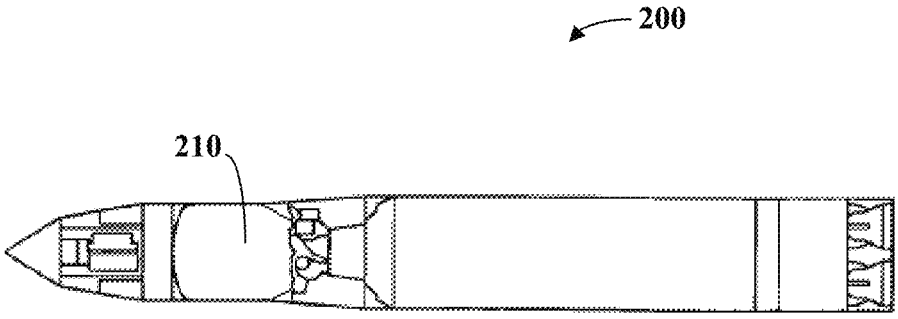
FIG. 8 is a missile diagram illustrating the high energy insensitive explosive particles configured into a missile warhead according to certain embodiments of the present invention.

The coated crystalline energetic particles can be configured 180 into a desired application. For instance, the coated crystalline energetic particles may be transferred to a load, assemble, and pack (LAP) facility where the coated crystalline energetic particles are pressed into warhead configurations for use in various tactical weapon platforms. LAP facilities use varying methods to accomplished warhead pressing. An example of a standard operation in which the coated crystalline energetic particles could be used is in the configuration of an explosive warhead having a final weight target of about 9 pounds for a standard tactical missile. The coated crystalline energetic particles could be weighed up in increments of 3 additions of 3 pounds each. The warhead is placed into an 80 to 100 ton press apparatus where the first increment of an energetic material would be loaded. However, the higher bulk density and compression strength of the coated crystalline energetic particles of the present invention allows the LAP to accelerate the pressing operation and allows each compaction of the explosive in the warhead to be done singularly instead of in multiple iterations. After the third increment loading, the final press application is applied and the warhead is ready for attachment to tactical weapon platform. For instance, as shown in FIG. 8, the coated crystalline energetic particles can be configured into a single, dense billet warhead explosive 210 that can be contained inside the delivery system of a missile 200. If the missile is now subjected to shock by fragments, bullet, shrapnel, or an adjacent munition, the weapon will react in a non-violent manner protecting the warfighter.

The coated crystalline energetic particles can be configured into a warhead for a desired tactical missile. Exemplary tactical missiles include JAVELIN™, HELLFIRE™, and TOW IIB™. The coated crystalline energetic particles can also be configured into less powerful tactical weapon platforms, including, for example, shoulder launched missiles, grenades, artillery, or other munitions.

In some aspects, the high energy insensitive explosive of the present invention has a reduced shock sensitivity of at least 25% compared to the same crystalline energetic particles having a standard average particle size using the Naval Ordnance Laboratory Large Scale Gap Test, such as the same crystalline energetic particles having an average particle size greater than 10 microns. Additionally, the high energy insensitive explosive of the present invention may yield a two times increase in uni-axial compression testing as compared to the same standard crystalline energetic particles.

In some aspects, high energy insensitive explosive of the present invention has a press density greater than 1.6 up to about 1.9, in some aspects greater than about 1.7 and up to about 1.85, and in some aspects greater than about 1.75 up to about 1.9.

As one of ordinary skill in the art will appreciate, the coated crystalline energetic particles of the present invention may be used in various amounts in an explosive load of a tactical weapon device. In certain aspects, an explosive load of a tactical weapon device comprises at least 30%, preferably at least 40%, preferably at least 50%, preferably at least 60%, preferably at least 70%, preferably at least 80%, preferably at least 90%, preferably at least 95%, more preferably at least 99%, most preferably up to 100% of the coated crystalline energetic particles of the present invention.

EXAMPLES

Example 1—Fluid Energy Milled Crystalline Particles Coated with a Thermoplastic Elastomer A high energy insensitive explosive of the present invention was produced by fluid energy milling (FEM) a standard HMX Class 1 explosive in a Sturtavent micronizer mill to an average particle size below about 10 microns and greater than about 0.5 microns to provide a fluid energy milled HMX explosive material (FEM HMX explosive). Coating the FEM HMX explosive in a PBX coating apparatus by subjecting a water wet slurry of the reduced sized HMX Class 1 explosive with a lacquer comprised of ESTANE™ dissolved in methyl ethyl ketone solvent at a temperature of about 60-65° C. under agitation. The lacquer was transferred by a gravity feed to the PBX coating apparatus using a solvent-water ratio of about 3.8:1 (solvent-water). Precipitation of the thermoplastic elastomer onto the FEM HXM explosive particles was conducted until the average particle size was greater than 150 microns, as shown in FIGS. 2-3, which was then stopped by the addition of water. The organic solvent was distilled from the coated FEM HMX explosive crystalline particles followed by drying the coated FEM HMX explosive crystalline particles in a steam heated oven at a temperature between about 40° C. to about 60° C.

A series of evaluation testing was conducted to determine the effect that the reduced particle size prior to coating had on the high explosive material compared to LX-14 Explosive Military Specification MIL-H-48358. As compared to the explosive material LX-14 as the control, four samples were completed containing the following percentages of FEM HMX explosive crystalline material coated with the thermoplastic elastomer: Sample 1 (24% FEM HMX; 76% HMX Class 1), Sample 2 (30% FEM HMX; 70% HMX Class 1), Sample 3 (50% FEM HMX; 50% HMX Class 1), and Sample 4 (100% FEM HMX). Besides Sample 2 having 30% of FEM HMX explosive crystalline particles, Sample 2 also contained the nitroplasticizer additive BDNPA/F (1:1 mixture of bis (2,2-dinitropropyl)-acetal and bis (2-2-dinitropropyl)-formal).

TABLE 1

Analytical Data.

| Sample | FEM HMX, % | % Retained 5/16 (O Max) | 4 (1 Max) | 50 (95 Min) | 80 (98 Min) | Bulk Density (0.85 Min) | Naval Impact |
|---|---|---|---|---|---|---|---|
| Control | 0 | 0 | 0 | 100.0 | 100.0 | 0.93 | — |
| 1 | 24 | 0 | 0 | 95.8 | 98.3 | 0.916 | 84.14 |
| 2 | 30 | 0 | 0.1 | 98.3 | 99.5 | 0.87 | 50.12 |
| 3 | 50 | 0 | 0 | 98.2 | 99.3 | 0.918 | 90.78 |
| 4 | 100 | 0 | 0 | 98.6 | 100.0 | 0.874 | 89.13 |

| Sample | FEM HMX, % | Composition, % Estane | Friction | ESD | Press Density (g/ml) |
|---|---|---|---|---|---|
| Control | 0 | 4.68 | — | — | 1.784 |
| 1 | 24 | 4.45 | >360 | 0.1013 | 1.737 |
| 2 | 30 | 4.54 | >360 | 0.0888 | 1.772 |
| 3 | 50 | 4.43 | >360 | 0.2113 | 1.767 |
| 4 | 100 | 4.67 | >360 | 0.0829 | 1.67 |

As shown in the analytical data of Table 1, all of Samples 1-4 having FEM HMX explosive crystalline particles coated with the thermoplastic elastomer met the MIL-H-48358 specification for composition, impact, friction and granulation. The press density of each sample was also assessed and found to lower as the percentage of FEM increased in the composition.

Explosive characterization testing was also conducted on Samples 1-4 to determine performance of the explosive as compared to standard explosive material LX-14 as the control. Blast overpressure was determined by initiating the explosive compositions and recording detonation overpressure data using three PCB piezoelectric pencil gauge pressure transducers at axial orientation of 5 feet, 10 feet and 15 feet. Additionally, shock sensitivity data was determined using the Naval Ordnance Laboratory (NOL) Large Scale Gap Test (LSGT). The test data is summarized in Table 2.

TABLE 2

Blast Overpressure and Sensitivity Data.

| Sample (FEM HMX, %) | Overpressure-Axial Orientation 5 Feet | 10 Feet | 15 Feet | LSGT | % LSGT Reduction |
|---|---|---|---|---|---|
| Control (0%) | 31.70 | 6.36 | 3.25 | 236 | — |
| 1 (24%) | 35.29 | 6.07 | 3.23 | 204 | 13.56 |
| 2 (30%) | 37.74 | 6.62 | 3.44 | 205 | 13.14 |

TABLE 2-continued

| Blast Overpressure and Sensitivity Data. | | | | | |
|---|---|---|---|---|---|
| Sample | Overpressure-Axial Orientation | | | | % LSGT |
| (FEM HMX, %) | 5 Feet | 10 Feet | 15 Feet | LSGT | Reduction |
| 3 (50%) | 38.35 | 7.06 | 3.45 | 202 | 14.41 |
| 4 (100%) | 37.36 | 6.14 | 3.52 | 176 | 25.42 |

The data in Table 2 illustrates that all of the formulations containing the FEM HMX explosive crystalline particles coated with the thermoplastic elastomer a reduction exceeded detonation overpressure results of the LX-14 control. Also, the data illustrates a reduction in sensitivity as the amount of the FEM HMX explosive crystalline particles coated with the thermoplastic elastomer is increased in the explosive formulation. Sample 4 had over a 25% reduction in sensitivity compared to the LX-14 control.

Example 2—Optimization of Coated Fluid Energy Milled Crystalline Particles

A high energy insensitive explosive of the present invention was produced as disclosed in Example 1. From testing it was determined that explosive formulations containing 80% FEM HMX (20% LX-14) explosive crystalline material (Sample 5) and 100% FEM HMX explosive crystalline material (Sample 6), both coated with the thermoplastic elastomer, were optimal for reducing the explosive hazard and maintaining lethality based on overpressure requirements. Detonation velocity and plate dent testing was conducted in duplicate on 80% FEM HMX (20% HMX Class 1) (Sample 5) and 100% FEM HMX (Sample 6) using standard Detonation Velocity (VOD) testing with the resulting data shown in Table 3.

TABLE 3

| Detonation Velocity and Plate Dent Results. | | |
|---|---|---|
| Sample (% FEM HMX) | Detonation Velocity (mm/μs) | Dent (inches) |
| 1 (0%) | 8.08 | — |
| 5 (80%) | 8.63 | 0.419 |
| 5 (80%) | 8.65 | 0.419 |
| 6 (100%) | 8.63 | 0.421 |
| 6 (100%) | 8.63 | 0.415 |

Additionally, shock sensitivity data was determined using the Naval Ordnance Laboratory (NOL) Large Scale Gap Test (LSGT) at higher explosive density using the 80% and 100% FEM HMX Class 1 explosive crystalline materials (Samples 5 and 6) to determine if the shock value could be lowered from the 176 cards previously attained (see Table 2). Higher explosive density was obtained by pressing the explosive material into denser billets for testing. The NOL LSGT data is shown in Table 4 for 80% FEM HMX explosive crystalline material and Table 5 for 100% FEM HMX explosive crystalline material. Three pellets were used for each shot.

TABLE 4

| NOL LSGT Results for 80% FEM (Sample 5). | | | |
|---|---|---|---|
| Shot | Gap (inches) | Result (Go/No-Go) | Notes |
| 1 | 1.80 | No-Go | |
| 2 | 1.67 | No-Go | |
| 3 | 1.60 | Go | |
| 4 | 1.64 | Go | |
| 5 | 1.66 | No-Go | N + 1 |
| 6 | 1.65 | Go | N |
| 7 | 1.65 | Go | N |
| 8 | 1.66 | Go | N + 1 |
| 9 | 1.67 | No-Go | N + 2 |
| 10 | 1.67 | Go | N + 2 |

TABLE 5

| NOL LSGT Results for 100% FEM (Sample 6). | | | |
|---|---|---|---|
| Shot | Gap (inches) | Result (Go/No-Go) | Notes |
| 1 | 2.00 | No-Go | |
| 2 | 1.50 | Go | |
| 3 | 1.80 | No-Go | |
| 4 | 1.65 | No-Go | |
| 5 | 1.55 | Go | |
| 6 | 1.61 | Go | N |
| 7 | 1.64 | No-Go | |
| 8 | 1.62 | No-Go | N + 1 |
| 9 | 1.61 | No-Go | N |
| 10 | 1.62 | Go | N + 1 |

As shown in the data of Tables 4 and 5, the higher pressures showed a reduction of the NOL LGST value to 166.5 cards for 80% FEM HMX explosive crystalline material and 161.5 cards for 100% FEM HMX explosive crystalline material, which is a 29.4% shock sensitivity reduction for the 80% FEM HMX explosive crystalline material and a 31.5% shock sensitivity reduction for the 100% FEM HMX explosive crystalline material compared to the control (0% FEM HMX explosive crystalline material) in Table 2.

Uniaxial Compression testing was also conducted on both the 80 and 100% FEM HMX explosive crystalline materials (Samples 5 and 6) at three different temperatures (63° C., 23° C. and −32° C.) using standard test protocols. The Uniaxial Compression data is shown in Table 6.

TABLE 6

| Uniaxial Compression Data for 80% and 100% FEM (Samples 5 and 6). | | | | |
|---|---|---|---|---|
| Temp (° C.) | Sample (% FEM) | Yield Stress (MPa) | Strain @ Yield | Modulus (MPa) |
| 63 | 5 (80%) | 18.4 | 0.0327 | 631 |
| | 6 (100%) | 22.6 | 0.039 | 568 |
| 23 | 5 (80%) | 42.5 | 0.0371 | 1233 |
| | 6 (100%) | 49.8 | 0.042 | 1286 |
| | 1 (0%) | 19.4 | 0.028 | 940 |
| −32 | 5 (80%) | 83.5 | 0.0395 | 2333 |
| | 6 (100%) | 120.5 | 0.0495 | 2529 |

As illustrated from the Uniaxial Compression Data in Table 6, both 80% and 100% FEM HMX explosive crystalline materials (Samples 5 and 6) showed an increase in strength compared to the control having 0% FEM HMX explosive crystalline material.

Example 3—Fluid Energy Milled Crystalline Particles Coated with a Plasticizer/Plastic Binding System A high energy insensitive explosive of the present invention was produced by fluid energy milling (FEM) a standard HMX Class 1 explosive having an average particle size between about 100 microns and 130 microns in a Sturtavent micronizer mill to an average particle size below about 12 microns and greater than about 0.8 microns, more particularly between about 2 microns and about 11 microns, to provide a fluid energy milled HMX explosive material (FEM HMX explosive). The FEM HMX explosive was coated in a PBX coating apparatus by subjecting a water wet slurry of the reduced sized HMX Class 1 explosive with a lacquer comprised of HYTEMP™ and dioctyl adipate dissolved in methyl ethyl ketone solvent at a temperature of about 60-65° C. under agitation. The lacquer was transferred by a gravity feed to the PBX coating apparatus using a solvent-water ratio of about 3.8:1 (solvent-water). Precipitation of the plasticizer/plastic binding system onto the FEM HXM explosive particles was conducted until approximately half of the coated particles passed through a No. 40 sieve, which was then stopped by the addition of water. The organic solvent was distilled from the coated FEM HMX explosive crystalline particles followed by drying the coated FEN HMX explosive crystalline particles in a steam heated oven at a temperature between about 40° C. to about 60° C.

The coated FEM HMX explosive crystalline particles were mixed in various amounts with standard HMX Class 1 bonded with HYTEMP™ and dioctyl adipate (PBXN-9), as summarized in Table 7.

TABLE 7

PBXN-9 with FEM HMX Coated with a Plasticizer/Plastic Binding System.

| Sample | Target % FEM | % DOA | % HMX | % Hytemp | Cup BD | % Passing No. 6 | % Passing No. 8 | % Passing No. 40 |
|---|---|---|---|---|---|---|---|---|
| | | 5-7 | 91-93 | 1.5-3 | >0.8 g/cc | 99-100 | 95-100 | 0-5 |
| 7a | 25 | 5.59 | 92.26 | 2.14 | 0.925 | 99.8 | 98.8 | 1.0 |
| 7b | 25 | 5.45 | 92.70 | 1.85 | 0.914 | 100.0 | 96.9 | 2.5 |
| 7c | 25 | 5.47 | 92.85 | 1.68 | 0.940 | 100.0 | 98.0 | 4.5 |
| 8a | 45 | 6.26 | 91.77 | 1.97 | 0.982 | 100.0 | 99.9 | 1.6 |
| 8b | 45 | 6.24 | 91.82 | 1.90 | 0.936 | 99.9 | 99.1 | 4.0 |
| 8c | 45 | 5.78 | 92.34 | 1.88 | 0.954 | 100.0 | 98.9 | 3.2 |
| 9a | 75 | 5.79 | 92.24 | 1.97 | 0.842 | 99.0 | 98.6 | 3.0 |
| 9b | 75 | 6.08 | 91.91 | 2.01 | 0.846 | 99.8 | 99.3 | 2.2 |
| 9c | 75 | 5.89 | 92.02 | 2.09 | 0.877 | 99.4 | 98.7 | 3.6 |
| 10a | 90 | 6.14 | 91.79 | 2.07 | 0.806 | 99.8 | 99.6 | 6.3 |
| 10b | 90 | 6.25 | 91.67 | 2.08 | 0.784 | 99.9 | 99.8 | 7.4 |
| 10c | 90 | 6.16 | 91.82 | 2.02 | 0.780 | 99.8 | 99.6 | 56.2 |
| 11a | 100 | 6.08 | 92.02 | 1.90 | 0.688 | 100.0 | 100.0 | 56.0 |
| 11b | 100 | 6.13 | 91.89 | 1.98 | 0.702 | 100.0 | 100.0 | 57.5 |
| 11c | 100 | 5.96 | 92.09 | 1.95 | 0.711 | 100.0 | 100.0 | 41.0 |

Shock sensitivity data was determined using the Naval Ordnance Laboratory (NOL) Large Scale Gap Test (LSGT) at higher explosive density using 0% (control), 45% (Sample 8b), 75% (Sample 9b) and 100% (Sample 11b) FEM HMX Class 1 explosive crystalline materials to determine shock values at the various mixtures. The NOL LSGT test data is summarized in Table 8.

TABLE 8

NOL LSGT Data for FEM HMX Coated with a Plasticizer/Plastic Binding System

| Sample | % FEM | % DOA | % HYTEMP | NOL LSGT | Pressed Density | % TMD |
|---|---|---|---|---|---|---|
| Control | 0 | 6.30 | 1.80 | 186.5 | 1.694 | 95.2 |
| 8b | 45 | 6.24 | 1.90 | 184.5 | 1.6756 | 94.1 |
| 9b | 75 | 6.08 | 2.01 | 186.5 | 1.6528 | 92.9 |
| 11b | 100 | 6.13 | 1.98 | 156 | 1.6487 | 92.6 |

As shown by the data of Table 8, the 100% FEM HMX explosive crystalline material coated with the plasticizer/plastic system showed a reduction of the NOL LGST value to 156 cards indicating a shock sensitivity reduction compared to the control (0% FEM HMX explosive crystalline material).

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of claim interpretation, it is expressly intended that the provisions of 35 U.S.C. § 112(f) are not to be invoked unless specific terms "means for" or "step for" are recited.

The invention claimed is:

1. A high energy insensitive explosive composition, the composition consisting of:

a plurality of crystalline energetic particles coated with at least one elastomeric material, wherein at least 80% of the plurality of crystalline energetic particles comprises 1,3,5,7-tetranitro-1,3,5,7-tetraazacyclooctane having an average particle size of less than about 30 microns, wherein the at least one elastomeric material is present in an amount greater than 3 wt-% up to about 10 wt-% based upon the total weight of the high energy insensitive explosive composition such that the plurality of coated crystalline energetic particles have an average particle size greater than about 50 microns, a press density greater than 1.6 and less than about 1.9 and wherein the plurality of coated crystalline energetic particles have a shock sensitivity less than a comparable plurality of crystalline energetic particles consisting of 1,3,5,7-tetranitro-1,3,5,7-tetraazacyclooctane having an average particle size greater than 30 microns using the Naval Ordnance Laboratory Large Scale Gap Test, wherein the at least one elastomeric material comprises a polyester-based thermoplastic polyurethane, a polyether-based thermoplastic polyurethane, a polyacrylates, or a combination thereof.

2. The high energy insensitive explosive composition of claim 1, wherein the plurality of crystalline energetic particles prior to being coated has an average particle size between about 0.5 microns to about 20 microns.

3. The high energy insensitive explosive composition of claim 1, wherein at least 80% of the plurality of crystalline energetic particles comprising 1,3,5,7-tetranitro-1,3,5,7-tetraazacyclooctane prior to being coated have an average particle size of less than about 10 microns.

4. The high energy insensitive explosive composition of claim 1, wherein up to 100% of the plurality of crystalline energetic particles comprises 1,3,5,7-tetranitro-1,3,5,7-tetraazacyclooctane having an average particle size of less than about 10 microns.

5. The high energy insensitive explosive composition of claim 1, wherein the at least one elastomeric material is present in an amount greater than 4 wt-% up to about 8 wt-% based upon the total weight of the high energy insensitive explosive composition.

6. The high energy insensitive explosive composition of claim 1, wherein the plurality of coated crystalline energetic particles have an average particle size greater than about 50 microns and up to about 5000 microns.

7. The high energy insensitive explosive composition of claim 1, wherein the plurality of coated crystalline energetic particles have a shock sensitivity reduction of at least 25% compared to the comparable plurality of crystalline energetic particles consisting of 1,3,5,7-tetranitro-1,3,5,7-tetraazacyclooctane having an average particle size greater than 30 microns using the Naval Ordnance Laboratory Large Scale Gap Test.

8. A method of manufacturing a high energy insensitive explosive composition, the method consisting of:

providing a plurality of crystalline energetic particles, wherein at least 80% of the plurality of crystalline energetic particles comprises 1,3,5,7-tetranitro-1,3,5,7-tetraazacyclooctane having an average particle size of less than about 30 microns; and coating the plurality of crystalline energetic particles with at least one elastomeric material to provide a plurality of coated crystalline energetic particles, wherein the at least one elastomeric material present in an amount greater than 3 wt-% up to about 10 wt-% based upon the total weight of the high energy insensitive explosive composition such that the plurality of coated crystalline energetic particles have an average particle size greater than about 50 microns;

pressing and compacting the high energy insensitive explosive composition into a desired configuration for a munition, wherein the pressing and compacting of the explosive in the munition is done singularly instead of in multiple iterations;

wherein the plurality of coated crystalline energetic particles have a shock sensitivity less than a comparable plurality of crystalline energetic particles consisting of 1,3,5,7-tetranitro-1,3,5,7-tetraazacyclooctane having an average particle size greater than 30 microns using the Naval Ordnance Laboratory Large Scale Gap Test.

9. The method of claim 8, further comprising providing a source of crystalline energetic particles comprising 1,3,5,7-tetranitro-1,3,5,7-tetraazacyclooctane having an average particle size greater than 30 microns into a micronizer mill, and milling the source of crystalline energetic particles to an average particle size less than about 30 microns.

10. The method of claim 8, further comprising providing the crystalline energetic particles comprising 1,3,5,7-tetranitro-1,3,5,7-tetraazacyclooctane having an average particle size less than about 30 microns in a water wet slurry prior to coating.

11. The method of claim 10, further comprising feeding a lacquer comprising the at least one elastomeric material dissolved into an organic solvent into the water wet slurry to form a mixture and precipitate the at least one elastomeric material onto each of the plurality of crystalline energetic particles.

12. The method of claim 11, wherein the at least one elastomeric material is dissolved into an organic solvent at a temperature between about 25° C. and about 65° C. to form the lacquer.

13. The method of claim 11, further comprising distilling the organic solvent from the mixture.

14. An explosive device, the device consisting of:

a compressed high energy insensitive explosive composition, the compressed high energy insensitive explosive composition comprising a plurality of crystalline energetic particles coated with at least one thermoplastic elastomer, wherein at least 80% of the plurality of crystalline energetic particles comprises 1,3,5,7-tetranitro-1,3,5,7-tetraazacyclooctane having an average particle size of less than about 30 microns, wherein the at least one elastomeric material is present in an amount greater than 3 wt-% up to about 10 wt-% based upon the total weight of the high energy insensitive explosive composition such that the plurality of coated crystalline energetic particles have an average particle size greater than about 50 microns, wherein the compressed high energy insensitive explosive composition has a shock sensitivity less than a comparable explosive composition consisting of a plurality of uncoated crystalline energetic particles of 1,3,5,7-tetranitro-1,3,5,7-tetraazacyclooctane having an average particle size greater than 30 microns using the Naval Ordnance Laboratory Large Scale Gap Test, and wherein the plurality of coated crystalline energetic particles have a press density greater than 1.6 and less than about 1.9.

15. The explosive device of claim 14, wherein the plurality of coated crystalline energetic particles are configured into an explosive device selected from a missile warhead, grenade, shoulder launched missile, artillery or bomb.

16. The explosive device of claim 14, wherein the compressed high energy insensitive explosive composition has a shock sensitivity reduction of at least 25% using the Naval Ordnance Laboratory Large Scale Gap Test compared to a compressed high energy explosive comprising crystalline energetic particles having an average particle size greater than 30 microns prior to being coated with the same at least one thermoplastic elastomer.

* * * * *